United States Patent [19]

Tafoya

[11] Patent Number: 4,964,821

[45] Date of Patent: Oct. 23, 1990

[54] JET POWERED RIGID INFLATABLE BOAT WITH DEAD-MAN SWITCH

[75] Inventor: Craig Tafoya, Ft. Lauderdale, Fla.

[73] Assignee: AutoBoat Corporation, Columbus, Ohio

[21] Appl. No.: 357,888

[22] Filed: May 30, 1989

[51] Int. Cl.[5] ..... B63B 7/08

[52] U.S. Cl. ..... 440/38; 440/1; 440/41; 440/86; 114/345

[58] Field of Search ..... 114/345, 56; 440/38, 440/41, 42, 43, 86, 1; 74/480 B

[56] References Cited

U.S. PATENT DOCUMENTS

| | | | |
|---|---|---|---|
| 3,478,712 | 11/1969 | Fox | 440/43 |
| 3,756,185 | 9/1973 | Breslin | 440/42 |
| 3,934,538 | 1/1976 | Canazzi | 440/43 |
| 3,945,201 | 3/1976 | Entringer | 74/480 B |
| 4,004,542 | 1/1977 | Holmes | 440/38 |
| 4,026,235 | 5/1977 | Woodfill | 440/42 |
| 4,811,682 | 3/1989 | Hwang et al. | 114/345 |

FOREIGN PATENT DOCUMENTS

| | | | |
|---|---|---|---|
| 2617456 | 1/1989 | France | 114/345 |
| 2032871 | 5/1980 | United Kingdom | 440/38 |

*Primary Examiner*—Sherman Basinger
*Assistant Examiner*—Thomas J. Brahan
*Attorney, Agent, or Firm*—Colucci & Umans

[57] ABSTRACT

In a rigid inflatable boat having a rigid hull with a bottom wall and side walls having top edges carrying floatation pontoon, a water jet drive is mounted on the bottom wall near a transom closing the rear end of the hull. The jet drive has an inlet communicating with a hole through the bottom wall and an outlet communicating with a hole through the transom. A steering cowl arrangement is mounted around the outlet of the jet drive and is connected to a steering wheel and handle for controlling the direction of water discharge for the jet drive. Seals are provided between the floatation pontoons and the transom for avoiding entry of water into the hull. The boat includes a seat positioned forward of the jet drive to distribute weight evenly on the hull.

19 Claims, 3 Drawing Sheets

JET POWERED RIGID INFLATABLE BOAT WITH DEAD-MAN SWITCH

FIELD AND BACKGROUND OF THE INVENTION

The present invention relates in general to rigid inflatable boats, and in particular to a new and useful rigid inflatable boat which is powered by a water jet drive.

Rigid inflatable boats generally comprise a rigid hull having a bottom and side walls with upper edges that carry inflatable bladders or pontoons.

Boats of this design have several advantages including buoyancy, stability, speed and resiliency.

Examples of known designs for rigid inflatable boats can be found in U.S. Pat. No. 4,498,413; 4,660,497 and 4,724,792.

Water vehicles that are powered by water jet drives are also known. Such jet powered craft as the Yamaha Waverunner and Kawasaki Jet-Ski models have rigid hulls and become manned torpedos in the hands of an inexperienced rider. For this reason, many laws have been enacted governing the use of these vehicles on lakes and harbors.

SUMMARY OF THE INVENTION

An object of the present invention is to mount a water jet drive in a rigid inflatable boat so that the inherent advantages of a water jet drive can be used to compliment the inherent advantages of a rigid inflatable boat.

One major advantage of water jet drives is safety. Water jets have not external propellers which have obvious safety advantages, particularly for rigid inflatables which are often used during swimming and diving excursions. Jet drives can also be used in extremely shallow waters.

The water jet driven rigid inflatable boat of the present invention is like a "bumper car" with safe soft inflatable tubes at the sides. The inflatable boat also has a low center of gravity which enables a driver to stay in the boat even when the craft is being maneuvered quickly. This in turn keeps the boat from running unmanned and becoming a safety hazard.

The combination of a rigid inflatable boat with a jet drive thus would enhance the serviceability, safety and usefulness of the rigid inflatable boat.

One problem which has been overcome by the present invention is how and where to mount the relatively heavy and powerful water jet drive in the relatively small and light rigid inflatable. Jet drives are conventionally used with boats having lengths of 25 to 30 feet. According to the present invention, a jet drive can be mounted to a rigid inflatable which is as short as 10 feet, including its pontoon (8 feet without pontoons).

Accordingly, a further object of the present invention is to provide an improvement in a boat having a rigid hull with a bottom wall, a pair of side walls connected to the bottom wall, each side wall including an upper edge and a rear edge, and the hull including a transom connected to the bottom wall and between the rear edges of the side walls, the boat including flexible pontoon means connected to the upper edges of the side walls, the improvement comprising water jet means mounted on the bottom wall near the transom and having an inlet for receiving water and an outlet for discharging water with force to propel the boat; the bottom having a first hole therethrough communicating with the inlet and the transom having a second hole therethrough communicating with the outlet; and water steering means connected to the transom over the second hole for steering water discharged through the outlet.

Another object of the present invention is to provide an improvement in rigid inflatable boats which is simple in design, rugged in construction and economical to manufacturer.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
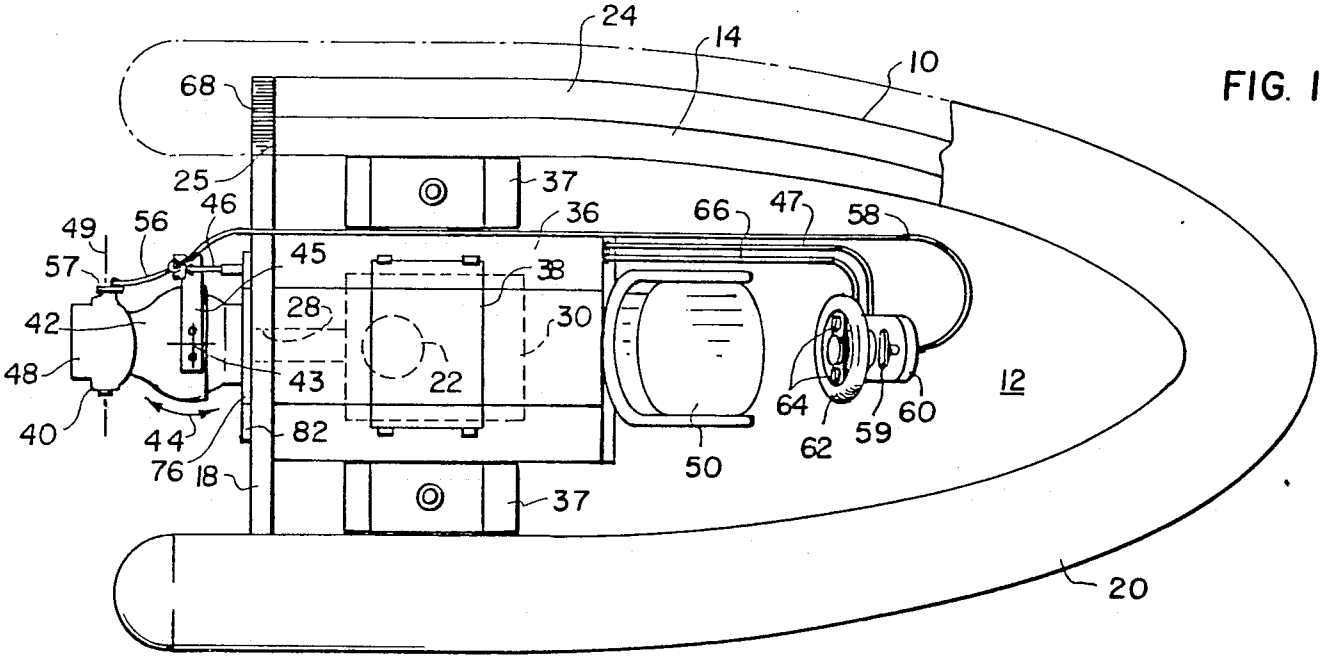
FIG. 1 is a top plan view of a rigid inflatable boat with water jet drive according to the present invention, with part of the pontoon removed to reveal the structure of the hull.

Referring to the drawings in particular, the invention embodied therein comprises a rigid inflatable boat having a rigid hull 10 with a bottom 12, side walls 14 with upper edges 24 and rear edges 25, and a transom 18 connected to the rear end of the bottom wall 12 and between the rear edges 25 of the side walls 14.

Hull 10 thus defines an interior space which only comes up to approximately the water line.

Pontoons 20 are fastened to the upper edges 24 of the side walls 14 (in a manner shown for example, in U.S. Pat. No. 4,724,792), at a location above the water line.

Figure 4:
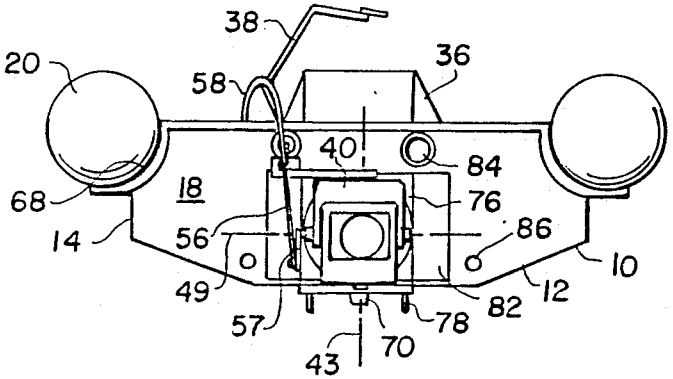
FIG. 4 is a rear elevational view of the boat shown in FIG. 1.

According to the present invention, a jet water drive 30 is mounted on the bottom wall 12 near the transom 18. Jet water drive 30 includes an engine which is confined within an engine housing 36 having a U-shaped access door 38 which is hinged to housing 36 and can be opened as shown in FIG. 4, to expose the engine for maintenance and repair.

The jet water drive 30 includes an inlet 32 which communicates with a hole 22 extending through the bottom wall 12 for receiving water into the jet drive. Jet drive 30 also includes an outlet 34 which communicates with a hole 28 through the transom 18, for discharging water under force to propel the boat.

Steering means 40 are connected to the transom 18 and are engaged around the outlet 34 for steering the flow of water.

A seat 50 is mounted on the hull bottom 12 forward of the drive housing 36. A control console 60 is mounted forward of the seat 50.

The positioning of the seat and controls forward of the drive compartment helps better distribute the weight of the engine and occupant on the rigid hull 10. This is particularly important for smaller hull lengths.

The engine of drive 30 is advantageously fed by a pair of fuel tanks 37 mounted on opposite sides of the housing 36, again to better distribute the weight in the hull.

The fuel tanks are the type used for professional raced go-karts, and are designed for high speed, high impact situations. The tanks are externally mounted for venting purposes.

Hull 10 is advantageously constructed of an inner molded shell 26 which forms the deck of the hull, an outer shell 29 which forms the exterior of the hull, and an intermediate floatation member 27, such as expanded foam or the like. The shells may be made of fiberglass, aluminum or other appropriate material. This construction provides strength, lightness and floatation. It is not particularly suited to support the relative heavy weight, and generated forces of the jet drive 30, however. For this reason, in accordance with the present invention, a portion of the inner shell 26 and floatation material 27 is removed at a location under the drive housing 36 and replaced by one or more wooden, formed aluminum or other rigid stringer 31, to which the housing and drive are bolted. This better distributes the weight and generated forces of the drive unit to the rest of the hull without seriously detrimenting the floatation ability of the hull construction.

Preferably, two teak stringers are used, each positioned on opposite sides of a central portion of the drive unit. One stringer is visible in FIG. 5.

The stringers can be mounted between the inner and outer shells or in a position to replace the section of inner shell which was removed to accommodate to the jet drive unit. As will be explained later, the jet drive is secured from the bottom through the outer shell and into the stringers. The inner shell assembly is also secured to the stringers at the top. This permits the thrust which is generated by the jet drive unit to be evenly transmitted through the hull as well as the transom. In one form of the invention, a 430 c.c. Cayuna water-cooled engine has been used to power the jet drive. Engine mounts such as those available on a Kawasaki Model X-2 Jet Ski vehicle, was used in this embodiment of the invention. The engine and mounts are also bolted to the stringers to make them rigid with the jet drive.

Steering means 40 comprises a steering cowl 42 that is rotatably mounted to the outlet 34 about a vertical axis 43 for rotation in the direction of arrow 44 in FIG. 1. To steer cowl 42, a bracket 45 is bolted or otherwise connected to the top of the cowl 42. Bracket 45 extends to one side of the cowl and is connected to a control member or cable 46 having a sheath 47 which extends to the control console 60. Cable 46 extends through the transom 18 near its upper edge and at the level of the pontoons. Cable 46 is operatively connected to a steering wheel 62 which is rotatably mounted to the console 60 and can be rotated in a conventional manner to pull and push the cable 46.

Start and stop switches 64 are mounted on opposite sides of the steering wheel 62 and can be depressed to start and stop the engine. A "dead man" throttle is connected to the drive 30 to operate the drive for discharging the flow of water. The throttle control is in the form of a spring loaded squeeze grip on the steering wheel 62. A lever and cable assembly, shown at cable 66, is used to connect the squeeze grip to the drive 30 to drop the drive into idle. If, for any reason, pressure is removed from the wheel, the throttle will be closed so that the engine of drive 30 is returned to idle speed.

Steering means 40 also include a reverse cowl 48 which is pivotally mounted about a horizontal axis 49 to the steering cowl 42. In its normal up position as shown in solid line in FIG. 2, cowl 48 is spaced away from the open end of outlet 34 to allow water to discharge in the direction of arrow 51. When reverse cowl 48 is rotated in the direction of arrow 52 about axis 49, the rear outlet is closed thereby diverting water through a secondary outlet 54 which directs the flow of water in the direction of arrow 55. This rearward and downward flow of water acts to pull the boat in a reverse direction. At the same time the downward component of the flow of water helps lift the transom 18 slightly out of the water to avoid the problem of having water flow into the hull over the transom. This is a particularly important problem to overcome in the rigid inflatable boat design which has a characteristically low transom.

In order to pivot reverse cowl 48 about its axis, a cable 56 it provided which is connected to a crank 57 that is fixed to the reverse cowl 48. A sheath 58 of cable 56 is connected to the console 60. Cable 56 extends over the transom and is connected to a handle 59 which is positioned above the steering wheel 62. Pulling handle 59 pulls cable 56 which rotates crank 57 to close cowl 48 over the rear outlet of the jet drive.

C-shaped cradles 68 are provided above the rear edges 25 of each of the side walls 14. Each cradle 68 carries a lining of water resistant material such as foam weather stripping, to help form a water seal between the pontoon and the rigid hull near the transom. This avoids inadvertent entry of water into the hull. This is important due to the tendency of jet drives to splash water, particularly when being steered.

Figure 6:
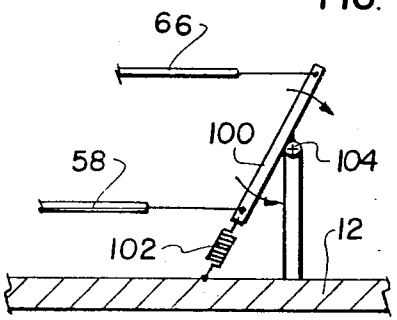
FIG. 6 is a partial view of a foot operated control for the drive of the boat.

In an alternative form of the invention, shown in FIG. 6, the reverse cowl 48 can be operated by a foot pedal 100. A toe and heel type gas pedal can be utilized as pedal 100, for forward and reverse motion. An adjustable spring 102 brings the foot pedal 100 into a neutral position when it is released. Neutral would represent a one-half forward and one-half reverse thrust for the jet drive. Pedal 100 is pivotally mounted to hull bottom 12 at axis 104 and has a top part connected to cable assembly 66 for forward thrust, and a bottom part connected to cable assembly 58 for reverse thrust.

Figure 3:
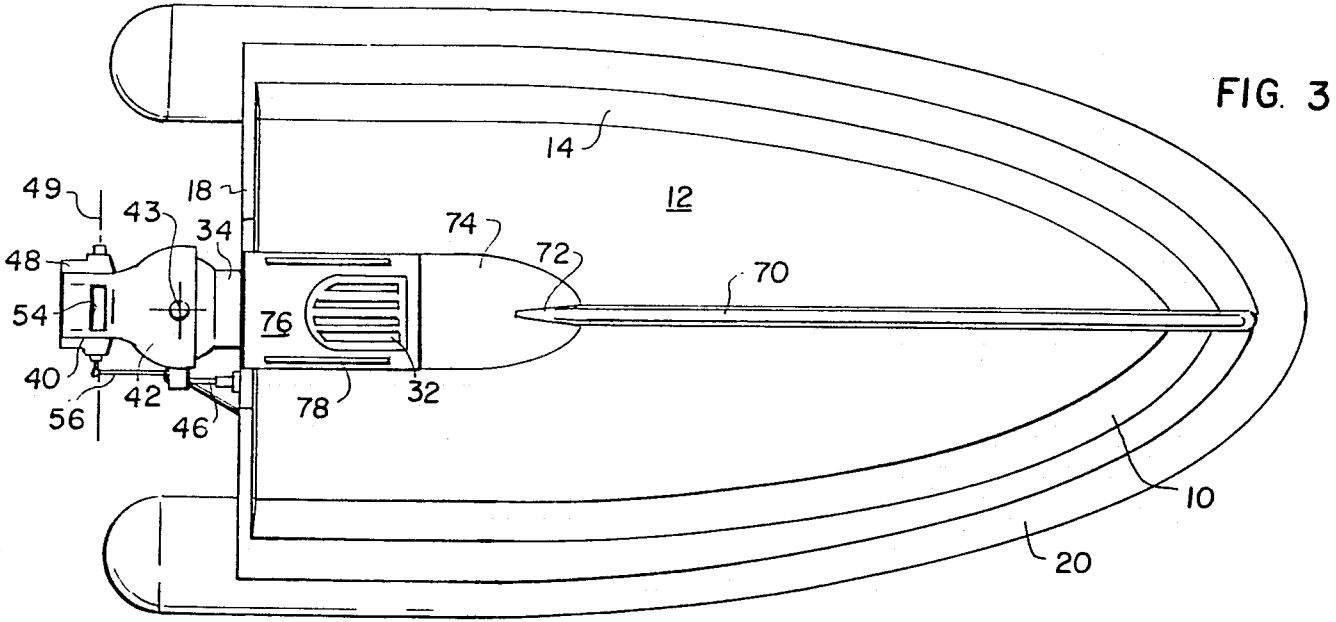
FIG. 3 is a bottom plan view of the boat shown in FIG. 1.

Turning to FIG. 3 in particular, hull 10 is provided with a keel 70 which gives the hull resistance against lateral movement in the water. According to the present invention, approximately the rear ¼ to ½ of keel 70 is removed and flared at 72 to meet a flat area 74 on the bottom surface of hull bottom 12. The bottom wall is thus free of the keel by ¼ to ½ of the length of the bottom wall. This flat area receives the flat lower portion of an L-shaped plate 76 that carries a grate covering the inlet 32 and hole 22. Fins 78 are provided on opposite sides of the inlet to replace the lateral stability lost by moving the rear portion of the keel 70.

Fins 78 also help channel the water into the inlet and avoid cavitation.

Figure 2:
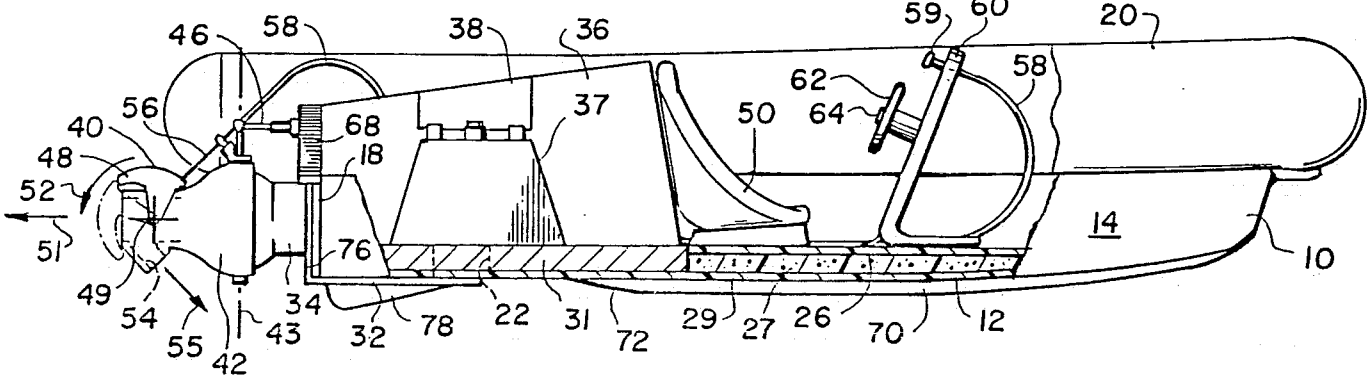
FIG. 2 is a side elevational view, partly in section, of the boat shown in FIG. 1.

As best shown in FIG. 2, the upright leg of L-shaped plate 76 carries the outlet 34.

Plate 76 is bolted to the bottom wall and transom of the hull and sealed thereto using silicone or other appropriate sealant. A PVC support block 82 is bolted between the upright leg of plate 76 and the transom 18 to further support and seal the plate to the transom and to make up any difference in angle between the transom and outer hull on the one hand, and the upright leg of the plate 76, on the other hand.

Figure 5:
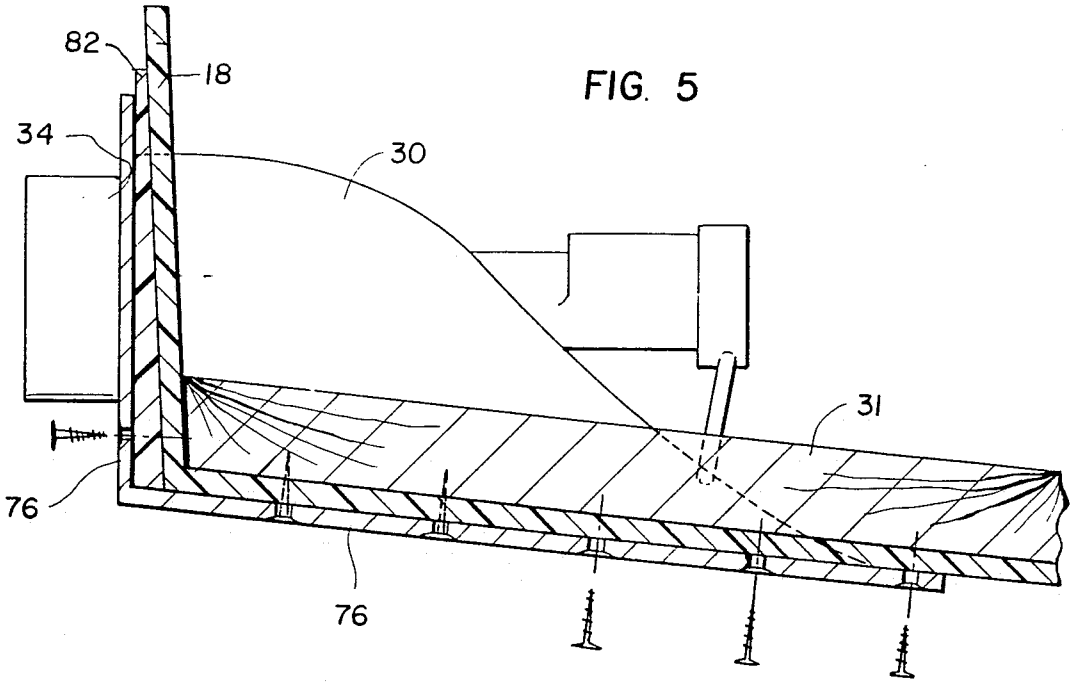
FIG. 5 is a partial sectional view showing the mounting of the jet drive.

As shown in FIG. 5, block 82 is preferably wedge shaped and is connected, for example, by screws that are inserted from the outside through the upright leg of plate 76 through the block 82 and into the transom 18. The lower screws are also advantageously attached into the rear end of stringers 31.

The horizontal leg of plate 76 receives screws from the bottom which are screwed through the outer shell and into the stringers 31 on opposite sides of a central housing for the jet drive 30.

PVC is used as the material for the support block 82 due to its flexibility which enables it to absorb and transfer thrust and vibration from the drive unit during high speed and reverse maneuvers.

An exhaust opening 84 is connected to the exhaust outlet of jet drive 30 and extends through the transom 18. Drains 86 which are required for jet drive 30 are provided near the lower end of transom 18.

The detailed structure of the water jet drive 30, the steering wheel 62 and the switches 64 are conventional and are not repeated here.

A further form of the invention, particularly if the invention is to go into mass production, would include stringers, engine cover, seat arrangement and steering console which are all made as one piece with the inner shell. This one piece construction is advantageously molded of fiberglass. This would allow all cables and wire connections to run under the deck between the console and the jet drive.

While a specific embodiment of the invention has been shown and described in detail to illustrate the application of the principles of the invention, it will be understood that the invention may be embodied otherwise without departing from such principles.

What is claimed is:

1. In a boat having a rigid hull with a bottom wall, a pair of side walls connected to the bottom wall, each side wall including an upper edge and a rear edge, and the hull including a transom connected to the bottom wall and between the rear edges of the side walls, the boat including flexible pontoon means connected to the upper edges of the side walls, the improvement comprising:

water jet means mounted on the bottom wall near the transom and having an inlet for receiving water and an outlet for discharging water with force to propel the boat;

the bottom having a bottom surface and a first hole therethrough communicating with the inlet and the transom having a second hole therethrough communicating with the outlet;

water steering means connected to the transom over the second hole for steering water discharged through the outlet;

a keel connected to the bottom surface of the bottom wall near a front of the bottom wall, the bottom wall being flat and being free of the keel near the rear of the bottom wall in the vicinity of the first hole through the bottom wall and the inlet of the water jet means; and a pair of fins extending parallel to the keel, on opposite sides of the inlet at a location spaced rearwardly of the keel and substantially rearwardly of said first hole.

2. The improvement of claim 1 wherein the bottom wall is free of the keel by ¼ to ½ of the length of the bottom wall.

3. The improvement of claim 1 including seat means for an occupant positioned forward of the water jet means and control means positioned forward of the seat means and operatively connected to the steering means for steering the water discharge.

4. The improvement of claim 3 wherein the water steering means comprises a steering cowl pivotally mounted to the outlet for rotation about a vertical axis and a reverse cowl pivotally mounted to the steering cowl for rotation about a horizontal axis, a steering member extending through the transom near an upper edge of the transom and at the level of the pontoon means, the steering member being connected between the steering cowl and the control means for pivoting the steering cowl.

5. The improvement of claim 4 including a reverse cable connected between the reverse cowl and the control means, said reverse cable extending over the transom.

6. The improvement of claim 5 including a supporting plate for carrying the water steering means, the outlet of the water jet means extending through the plate, and an adapter block connected between the transom and the plate for securing the plate and steering means to the transom.

7. The improvement of claim 6 wherein the water steering means comprises a steering cowl pivotally mounted to the outlet for rotation about a vertical axis and a reverse cowl pivotally mounted to the steering cowl for rotation about a horizontal axis.

8. The improvement of claim 7 including control means mounted forwardly of the water jet means and to the bottom wall, the control means being operatively connected to the steering and reverse cowls for pivoting the steering and reverse cowls.

9. The improvement of claim 5 wherein the control means include a steering wheel operatively connected to the steering member for pivoting the steering cowl with rotation of the steering wheel and a handle operatively connected to the reverse cable for pivoting the reverse cowl with movement of the handle.

10. The improvement of claim 1 including a C-shaped cradle connected to each side wall above the rear edge thereof, and at each side of the transom, and means on each cradle for sealing each cradle to a pontoon for avoiding entry of water between each cradle and each respective pontoon.

11. The improvement of claim 1 including a one piece L-shaped plate carrying the inlet and outlet of the water jet means, the L-shaped plate having a lower leg connected over the bottom wall and an upper leg connected over the transom, the upper and lower legs being sealed to the hull.

12. The improvement of claim 1 wherein said bottom wall comprises an inner shell forming a deck of the hull and an outer shell spaced outwardly of the inner shell and connected to the inner shell, the hull including an opening in the inner shell under the water jet means and a stiffening stringer in the opening connected to the hull and to the water jet means for supporting the water jet means.

13. The improvement of claim 11 wherein the water jet means comprises an engine mounted to the stringer near the transom, a housing connected over the motor and an access door hinged to the housing and openable for access to the engine.

14. The improvement of claim 13 including a pair of gas tanks supported on the bottom wall, on opposite sides of the housing.

15. A powered, rigid inflatable boat comprising:

a rigid hull defining an interior space having a bottom and a transom;

floatation pontoons connected to the hull and extending above the hull and on opposite sides of the transom;

the hull including a first hole through the bottom thereof near the transom and the transom including a second hole therethrough;

water jet drive means mounted on the bottom of the hull near the transom, said water jet drive means having an inlet communicating with the first hole and an outlet communicating with the second hole for receiving water through the first hole and discharging it under force through the second hole for propelling the boat;

a steering cowl pivotally mounted to the outlet for rotation about a vertical axis;

a reverse cowl pivotally mounted to the steering cowl for rotation about a horizontal axis;

seat means mounted on the hull bottom forward of the water jet means; and control means mounted near the seat means and operatively connected to the steering cowl, the reverse cowl and the water jet drive means, said control means including a "dead man" switch comprising a rocker type foot pedal pivotally connected to the rigid hull, spring means connected to the foot pedal for biasing the foot pedal into a neutral position when no foot force is applied to the foot pedal, corresponding to an idle condition for the control means, the control means including a trottle cable connected between the foot pedal and the water jet drive means for activating the water jet drive means for increasing the force of water passing through the water jet drive means to propel the boat when the foot pedal is pivoted in one direction beyond the neutral position, and a reverse cable connected between the pedal and the reverse cowl for pivoting the reverse cowl with rotation of the foot pedal in an opposite direction from the neutral position to propel the boat in a reverse direction, movement of the foot pedal into the neutral position positioning the trottle cable and the reverse cowl for neutral propulsion on the boat.

16. A boat according to claim 15 including a keel extending downwardly from the hull and terminating forward of the transom, an inlet grate over the first hole and inlet of the water jet means, and a pair of fins on opposite sides of the grate in a position rearward of the keel, substantially rearward of the first opening and adjacent the transom.

17. A boat according to claim 16 including sealing means connected to the hull on opposite sides of the transom for sealing to the floatation pontoons to avoid entry of water into the hull between the transom and the floatation pontoons.

18. A boat according to claim 15 wherein the jet drive means includes an engine, and fuel supply reservoirs on opposite sides of the engine near the transom and mounted on the bottom of the hull.

19. A boat according to claim 16 including sealing adaptor means connected between the outlet and the transom for sealing the outlet to the transom.

* * * * *